United States Patent [19]

Schmidgall

[11] 4,412,817

[45] Nov. 1, 1983

[54] CANOPY KILN SYSTEM

[75] Inventor: Ronald D. Schmidgall, Mediapolis, Iowa

[73] Assignee: Hawkeye Concrete Products Co., Mediapolis, Iowa

[21] Appl. No.: 369,062

[22] Filed: Apr. 16, 1982

[51] Int. Cl.[3] ..... F27D 1/00; F26B 19/00; E04B 1/12; A45B 9/04

[52] U.S. Cl. ..... 432/247; 34/201; 52/63; 52/83; 135/82

[58] Field of Search ..... 432/247; 34/201; 135/82, 90, 91, 96, 905; 52/27, 29, 63, 83

[56] References Cited

U.S. PATENT DOCUMENTS

| | | | |
|---|---|---|---|
| 1,478,396 | 12/1923 | Pownall | 52/29 |
| 1,548,795 | 8/1925 | Fuller | 432/247 |
| 1,849,738 | 3/1932 | Amico | 135/90 |
| 2,406,724 | 8/1946 | Waterman | 34/201 |
| 2,719,992 | 9/1955 | Campfield et al. | 52/63 X |
| 3,084,703 | 4/1963 | Lefebvre et al | 135/91 |
| 3,965,625 | 6/1976 | White | 52/29 |
| 4,287,674 | 9/1981 | Selivanov et al. | 34/201 |
| 4,381,629 | 5/1983 | Ahn | 52/63 |

*Primary Examiner*—John J. Camby
*Attorney, Agent, or Firm*—Henderson & Sturm

[57] ABSTRACT

A canopy kiln system is provided in the form of a flat-topped tent of flexible material (lightweight canvas, etc.) having depending walls to form, when in use, an enclosure for housing one or more articles to be treated or cured, one example being in the curing of cast concrete pipe. One end of the roof of the tent is attached to a wall or the like and is stretched out overlying the articles and has its free end provided with a transverse stiffener, referred to as a strongback. The strongback is detachably connected to support structure remote from the wall and the sides or curtains of the canopy form walls. The folding mechanism comprises an overhead hoist that picks up the strong-back and moves it—and of course the canopy—toward the wall. During this movement, intermediate lift mechanism picks up an intermediate part of the roof to keep it from sagging. At a predetermined point during pick-up of the canopy, the strongback is transferred to a cradle which carries the canopy completely to the wall in its folded position.

8 Claims, 5 Drawing Figures

CANOPY KILN SYSTEM

BACKGROUND OF THE INVENTION

One area in which the invention finds particular but not limited utility is in the manufacture of concrete pipe for use in drainage and other projects. Such pipes are commonly formed in steel molds disposed in upright positions. That is, each pipe is cast with its axis vertical. After the pipe has "set", the form or jacket is stripped from the pipe and the pipe is placed in a selected are a for curing, usually by means of a kiln, oftentimes heated by steam. It is also common practice to enclose the kiln, preferably by some form of portable or permanent structure in order to eliminate expense, maintenance and use of space that could be employed for other purposes.

Flexible material of any known form is preferred for the portable or temporary canopies but many problems arise in the covering and uncovering of pipe or other articles because the pipe alone is of substantial size, as is the kiln area, and consequently, the canopy becomes also of substantial size and weight and therefore can be heavy and cumbersome to handle. At the same time, it is desired that, when the kiln area is not in use for kiln purposes, it be made easily available for other purposes.

According to the present invention, the aforesaid and other problems are eliminated by the provision of an overhead system that easily and conveniently handles the canopy, moving it quickly between kiln and storage positions with a minimum of apparatus. The system uses pickup means to raise and lower the canopy—which in kiln position somewhat resembles a tent with a flat roof—over the pipe. When the canopy is picked up and stored, auxiliary supports for one end of the canopy may be removed from the floor, leaving the floor open and unobstructed. Means is provided for picking up the canopy at one end as well as in the middle so as to eliminate the sagging of the canopy onto the cured pipe during canopy folding and storage. Storage of the canopy is effected against a wall or similar support so that, although it is out of the way when stored, it is easily available to be lowered again over a new batch of pipe. etc. to be treated.

Further features and advantages will become apparent as a preferred embodiment of the invention is disclosed in detail in the ensuing description and accompanying sheets of drawings, the figures of which will be described immediately below.

DETAILED DESCRIPTION OF A PREFERRED EMBODIMENT OF THE INVENTION

Figure 2:
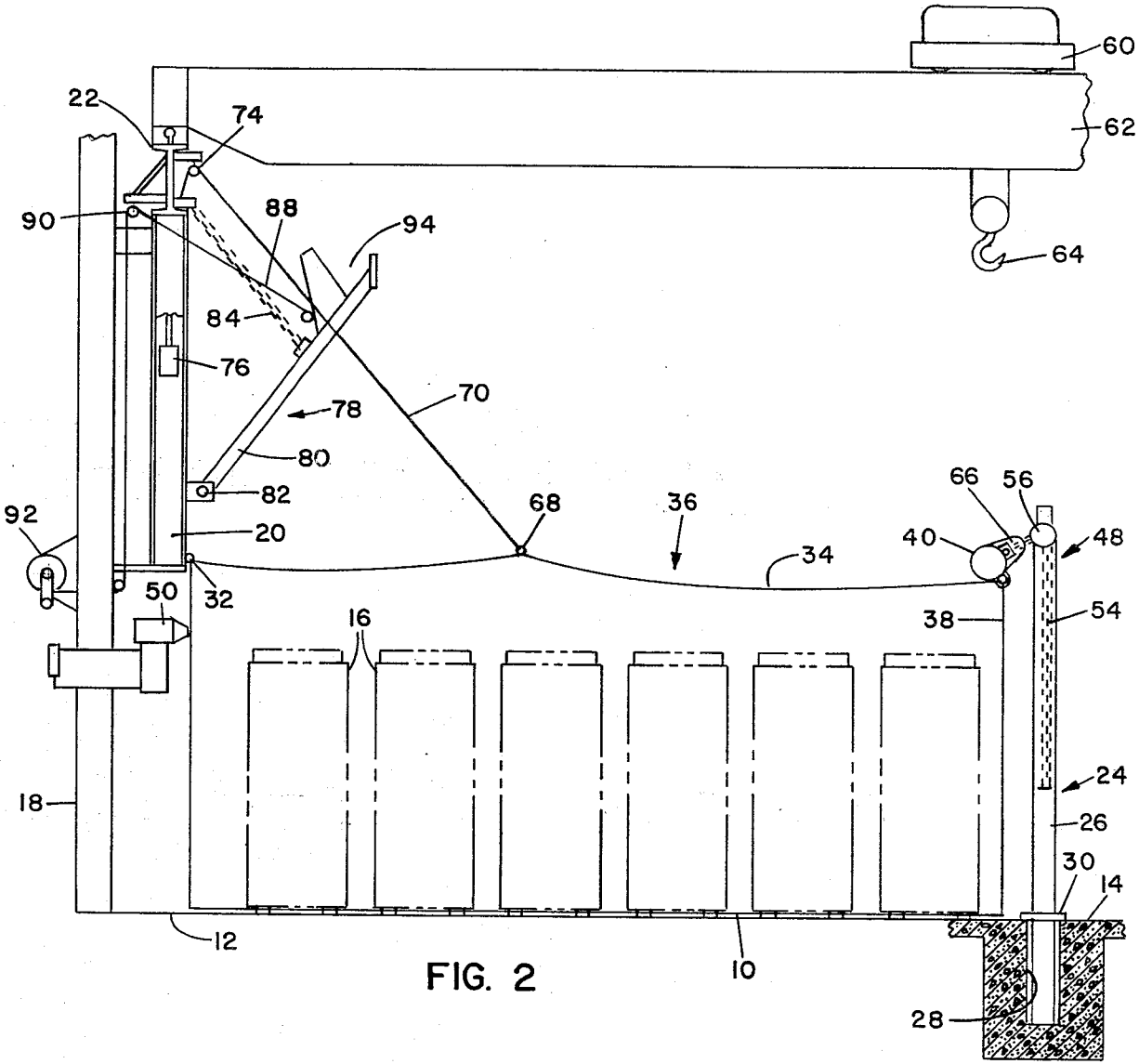
FIG. 2 is an elevation of the structure of FIG. 1, also somewhat schematic, showing the canopy in operating or kiln position.

As best shown in FIG. 2, a kiln area has been selected which has a floor 10 that serves as an elongated base. The floor or base may be regarded as having first and second, or rear and front, ends 12 and 14, which occur mainly as definitive portions of the particular area selected for kiln or equivalent purposes. In the present case, several articles in the form of sections of cast concrete pipe 16 stand upright on the floor. Considering that such pipe may range as high as six feet in diameter and over twice that in length, it will be seen that the invention is dealing with large objects and proportionately large associated equipment.

A first or rear support means 18 is provided, here in the form of a wall or wall-like structure which rises to a height considerably above the level of the tops of the pipe sections. Additional vertical structural members 20 and horizontal beams 22 fill out the upper part of the wall 12. A second or front support means 24 is provided at the end 14 of the floor. This means preferably comprises a pair of posts 26 of steel tubing or the like. Each of these has its lower end portion received in a suitable socket 28 formed in the floor, which may be wholly or partly concrete. Each post has a lower collar 30 to limit its descent into its socket. The posts are received in their sockets in such manner as to be easily removable upwardly, thus providing removable support means which, when removed, clear that area of the floor for other uses if desired. For example, it may be desired to load the cured pipe sections 16 from the floor at that end. The upper ends of the posts are above the level of the pipes or at about the level of a transverse bar 32 carried by the wall members 20. This bar serves as a connection for the rear transverse edge of a roof portion 34 of a canopy 36 which also includes side and front end walls or curtains 38. The front transverse end of the roof is detachably carried by a transverse stiffener means, here in form of a tubular steel member 40 preferably closed at its opposite ends and referred to as a strongback. The strongback is preferably attached to the canopy at the junction of the roof and front wall by means of a rod 42 carried by the strongback and passed through several spaced loops 44 at the aforesaid junction. The rod is carried by the strongback via suitable ears 46. See especially FIG. 1. The strongback is detachably carried by the upper ends of the post by means 48, to be described later.

From the description thus far, it will be seen that the canopy in use extends between the supports 18 and 24, with its roof over the standing pipes and curtains depending at at least three sides of the kiln area to form a substantial enclosure about the pipes. In the case of concrete pipes as here considered, heated steam is supplied to the interior of the kiln as via one or more nozzles 50. This method is peculiar to the present type of operation and does not limit exploitation of the invention.

As previously described, the canopy, even though made of the lightest materials consistent with its expected usage, is quite cumbersome, heavy and not easily manually handled, especially with reference to the kiln area involved. According to the present invention, this handling is achieved largely by power or equipment affording considerable mechanical advantage.

Figure 5:
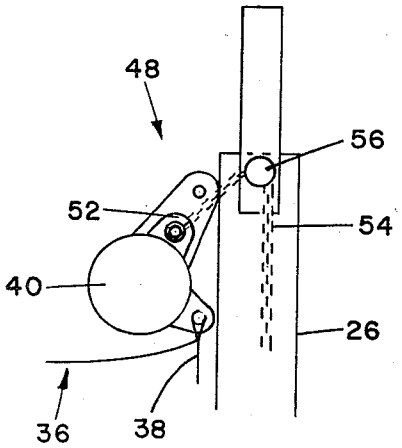
FIG. 5 is an enlarged, fragmentary view showing a form of mounting the strongback.

Basically, the canopy is picked up at its strongback end (or front) and folded rearward to and even against the wall structure 18–20. In furtherance of this aim, the strongback is detachably carried by the upper ends of the posts 26 as best shown in FIG. 5, wherein it is seen that the strongback has a pair of spaced ears 52 welded thereto, one in alinement with each post 26. A chain or the like 54 is connected to each ear, trained upwardly and then downwardly over a post-carried sheave 56 and then detachably connected to an anchor 58 rigid on a lower part of the post. The chains are anchored at positions selected according to the ultimate positioning of the canopy in kiln or operating position.

Figure 3:
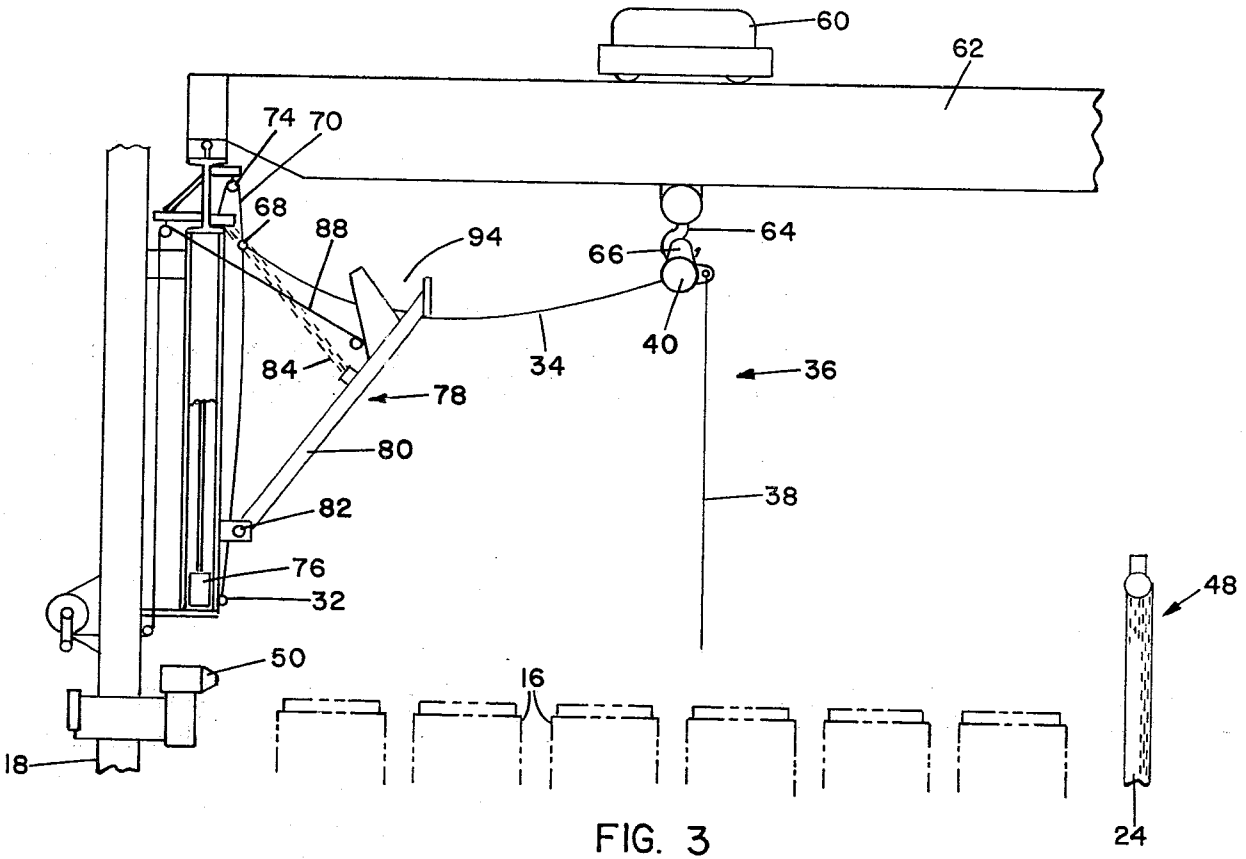
FIG. 3 is a fragmentary elevation like FIG. 2 and showing the canopy in an intermediate stage of being folded.

The means for lifting the canopy at its strongback or front end here includes a typical hoist 60 movable along a track 62 and powered in any suitable manner not material here. The track of course runs from front to rear over the kiln. The hoist includes a vertically movable pick-up hook 64 which is brought over the strongback and lowered when it is desired to begin the canopy pick-up operation. The center of the strongback carries rigidly thereon an upstanding pickup bale or loop 66 with which the hoist hook is engageable and from which the hook may be disengaged. As shown in FIG. 3, the initial step in folding the canopy is to pick up the strongback via the hoist and move it rearwardly and upwardly, the latter motion being required to keep the end wall 38 from dragging on the cured pipe section 16. Also, unless the roof is raised along with being lifted, substantially the entire canopy will sag onto and be dragged over the pipes, causing damage thereto.

Figure 1:
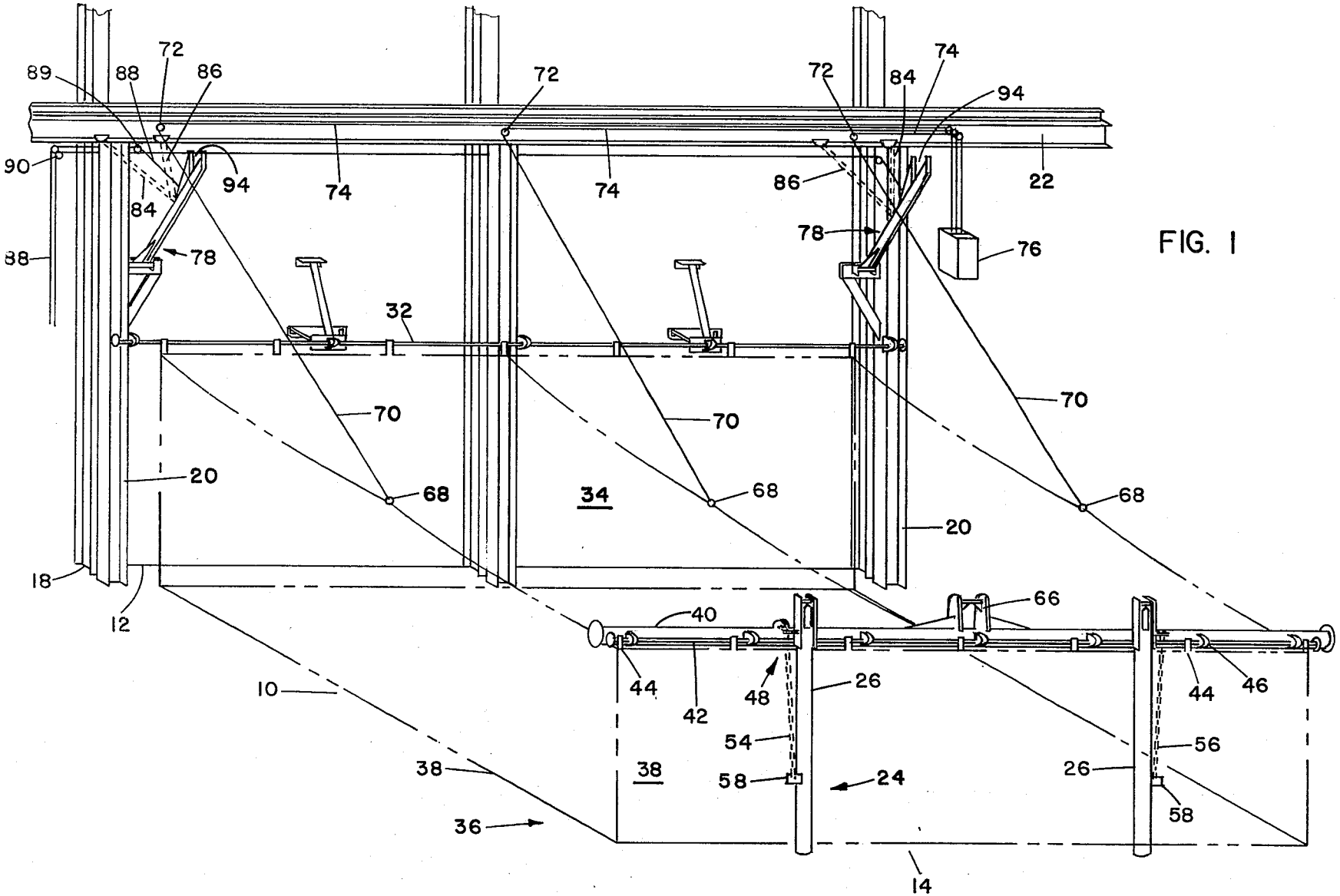
FIG. 1 is a perspective, in part schematic and with certain portions of the lift mechanism omitted, of the canopy and its supports.

As best seen in FIG. 1, transversely alined portions 68 of the canopy roof intermediate its front and rear ends are connected respectively to cables 70, each of which extends upwardly and rearwardly and is trained over a sheave 72 and extends thence laterally, as at 74, to another sheave and then downwardly to biasing means, here a weight 76 common to all cables. In the present case, three cables or lines are found adequate. As the hoist lifts the strongback and moves it to the rear, the roof becomes slack and the weight 76, via the cables 70, lifts the intermediate part of the roof and avoids sagging thereof.

Figure 4:
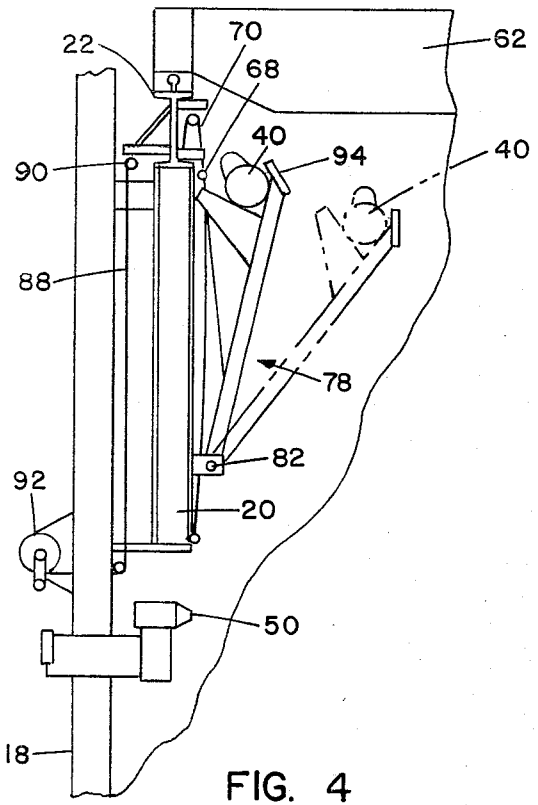
FIG. 4 is a fragmentary elevation showing the canopy ultimately folded, the dot-dash lines showing the receiver in its FIGS. 1 and 2 or receiving position.

It is another feature of the invention that the hoist transfers the strongback to receiving means 78 mounted to the rear wall 18–20 for disposition in an extended mode or position (FIGS. 1, 2 and 3) or retracted mode or position (full lines FIG. 4). This means here comprises a pair of similar, generally upright arms 80 pivoted at their lower ends at 82 to the wall structure 18–20 for swinging between the two positions noted. Swinging to the extended position of each arm is limited by limit means, here flexible elements in the form of main and brace chains 84 and 86 suitably connected between the arms and the wall structure 18–20. The arms are movable to their fully retracted positions by means including cables 88 connected to the arms, trained over sheaves 89 and 90 and connected to winch means 92; although, any other form of retracting means may be used. The upper end of each arm is equipped with cradle means 94 for receiving the strongback from the hoist hooks, which occurs as the hoist moves from its FIG. 3 position into vertical alinement with the cradle means, at which time the hoist hook is released from the strongback bail, as will appear in detail below.

The operation of the system will now be briefly described, assuming a starting position as in FIG. 2. The hoist is alined with the strongback and the hook lowered to make connection with the bail on the strongback. The strongback is disconnected from the upper ends of the support posts and the hoist is raised and moved along the track to the rear. As the roof slackens, the weight 76 and cables raise the intermediate part of the roof to the FIG. 3 position. The winch is reversed and the receiver cradles are extended forwardly to the limits of their chains 84 and 86. The hoist continues to the rear until the strongback is directly above the cradles and the strongback is then lowered onto or transferred to the cradles and the hook 64 disconnected from the strongback, which may be easily effected by the hoist operator. The hoist may then be moved forwardly to clear the cradles as the arms 80 are swung to their final rear positions by the winch or equivalent means to attain the FIG. 4 position. If the kiln area is to be inactive as a kiln for an extended position or for some other reason, the posts 26 may be removed from their floor sockets.

Positioning the canopy in operating or kiln position involves mainly a reversal of the foregoing procedure. After the kiln floor is loaded, the winch is operated to allow the cradles and strongback (which is over-center toward the front of the kiln) to swing out to the dot-dash position of FIG. 4 (full line positions in FIGS. 1–3). The hoist is brought over and manipulated until the hook 64 picks up the strongback and lifts it clear of the cradles. As the hoist moves to the front, and then downwardly carrying the strongback and front end of the canopy, the cables 70 pay out as the intermediate part of the roof is stretched. When the strongback attains the level of the upper ends of the posts and is alined therewith, the means 48 is connected, the hoist hook released and raised and the hoist moved elsewhere or left where it is, depending upon circumstances.

It is important to note that the cradle means swings out to receive the strongback because the hoist, at least in this instance, cannot approach the rear wall structure closely enough to deliver the strongback to its most "compact" storage position.

Features and advantages other than those specifically pointed out herein will have become apparent to those versed in the art as will many modifications in the preferred embodiment disclosed, all of which may be achieved without departure from the spirit and scope of the invention.

I claim:

1. A canopy kiln system comprising generally elongated means for supporting at least one article to be kiln-treated and having first and second end portions spaced longitudinally apart, first and second support means disposed respectively at and spaced above the first and second end portions at a level above the height of the article, an elongated canopy of flexible material extending generally horizontally between the two support means and having first and second transverse ends respectively adjacent to the first and second support means, means affixing the first end of the canopy to the first support means, transverse stiffener means at the second end of the canopy and affixed thereto, detachable means for connecting the stiffener means and thus the second end of the canopy to the second support means, overhead track means extending lengthwise of the canopy and between the two support means, a hoist carried by the track means for connection to the stiffener means to raise same and thus the second end of the canopy when the detachable means is detached from the second support means, said hoist being movable on the track means toward the first support means so as to at least partly uncover the article, and lift means connected to an intermediate portion of the canopy and to the first support means at a height above the canopy and operative, as the hoist moves along the track means toward the first support means, to exert a lifting force on the canopy to keep same clear of the top of the article.

2. The invention defined in claim 1, in which the lift means includes a flexible element connected to an intermediate portion of the canopy and biasing means connected between said element and the first support means to exert a lifting force on the canopy.

3. The invention defined in claim 1, including means carried by the first support means for receiving the hoist-carried stiffener means so as to free the hoist for other operations.

4. The invention defined in claim 3, in which said receiving means is mounted on the first support means for movement from an extended position toward the second support means for receiving the hoist-carried stiffener means to a storage position relatively close to the first support means, and means is provided for causing movement of the receiving means between its two positions.

5. The invention defined in claim 4, in which the receiving means has an upwardly opening cradle portion for receiving the stiffener means.

6. The invention defined in claim 4, in which the means for moving the receiving means comprises cable and winch mechanism.

7. The invention defined in claim 1, in which the second support means is detachably carried by the base means.

8. The invention defined in claim 7, in which the detachability of the second support means comprises socket means in the base means and post means on the second support means selectively receivable by and removable from the socket means.

* * * * *